US006256472B1

(12) United States Patent
Miyake et al.

(10) Patent No.: US 6,256,472 B1
(45) Date of Patent: Jul. 3, 2001

(54) TRANSFER DEVICE IN ELECTROPHOTOGRAPHY

(75) Inventors: Takashi Miyake, Osaka; Naoki Michiwaki, Sakai, both of (JP)

(73) Assignee: Kyocera Mita Corp., Osaka (JP)

( * ) Notice: Subject to any disclaimer, the term of this patent is extended or adjusted under 35 U.S.C. 154(b) by 0 days.

(21) Appl. No.: 09/511,111

(22) Filed: Feb. 23, 2000

(30) Foreign Application Priority Data

Feb. 26, 1999 (JP) ..... 11-051435

(51) Int. Cl.[7] ..... G03G 15/14
(52) U.S. Cl. ..... 399/313; 399/316
(58) Field of Search ..... 399/313, 314, 399/316, 317

(56) References Cited

U.S. PATENT DOCUMENTS 5,233,393 * 8/1993 Yoshida et al. ..... 355/271
5,408,300 * 4/1995 Wataki et al. ..... 355/276
5,502,554 * 3/1996 Hayashi et al. ..... 355/271
5,572,305 * 11/1996 Hayashi et al. ..... 399/121

* cited by examiner

*Primary Examiner*—Richard Moses
(74) *Attorney, Agent, or Firm*—Sherman & Shalloway

(57) ABSTRACT

In this transfer device, when a straight line is regarded to be a support axis P connecting a press-contacting point between the first roller and the drum to a press-contacting point between the second roller and the stopper, a moment of the resilient member of the second roller side to the support axis P is larger than the sum of a moment of the resilient member of the first roller side to the support axis P and a moment of the resilient means to the support axis P. Upon adjusting the moments as described above, a stable and reliable contact is maintained at the pair of press-contacting points of the positioning roller to the drum, completely preventing the deviation in the press-contacting points, stably and reliably limiting the gap between the transfer roller and the drum, and, hence, forming an excellently transferred image.

4 Claims, 3 Drawing Sheets

TRANSFER DEVICE IN ELECTROPHOTOGRAPHY

BACKGROUND OF THE INVENTION

1. Field of the Invention

The present invention relates to a transfer device used for an electrophotographic process (image-forming system) such as in a copier, printer, facsimile, etc. More specifically, the invention relates to a transfer device which stably and reliably limits the gap between a transfer roller and a photosensitive material in order to form an excellently transferred image.

2. Description of the Prior Art

As a transfer device for transferring a toner image formed on a photosensitive material drum in an image-forming apparatus based on the electrophotographic process, there has been known the one which employs a transfer roller that faces the photosensitive material drum, in order to transfer the image while passing a transfer sheet such as paper or the like between the photosensitive material drum and the transfer roller.

The transfer device which uses the transfer roller has an advantage in that it produces ozone in small amounts as compared with a transfer device which uses a corona charger.

It has also been known to dispose the transfer roller separated away from the photosensitive material. Japanese Unexamined Patent Publication (Kokai) No. 308843/1994 discloses a transfer device in an image-forming apparatus which includes an image-carrier (photosensitive material drum) and a transfer roller, and passes a transfer sheet therebetween to transfer the toner of the image carrier onto the transfer sheet, wherein the image carrier is an organic photosensitive material containing a charge-generating agent and a charge-transporting agent, the transfer roller formed of an electrically conducting polyurethane rubber composition which is so cured that the rubber hardness exceeds 50 degrees (JIS A), and the image carrier and the transfer roller are disposed being separated away from each other maintaining a small gap that is larger than the thickness of the transfer sheet but permits the toner to be transferred onto the transfer sheet.

To dispose the transfer roller maintaining a predetermined gap with respect to the photosensitive material, a positioning roller is generally brought into contact with the surface of the photosensitive material or with an extension thereof using an urging means such as spring or the like, so that a predetermined gap (which may often be smaller than the thickness of the paper) is maintained between the transfer roller and the photosensitive material.

In the transfer system using such a transfer roller, a guide plate must be provided in position between the transfer roller and the photosensitive material drum so that the transfer sheet such as paper is fed into between the transfer roller and the photosensitive material drum without causing the paper to be jammed.

To determine the position of the guide plate, it can be contrived to rotatably support a guide unit equipped with a guide plate in concentric with the transfer roller, provide a pair of engaging protrusions at both ends of the guide plate to come into engagement with the stoppers on the side of the photosensitive material drum, and provide a plurality of guide plate-urging means (resilient members such as springs or the like) for pushing the engaging protrusions onto the stoppers.

In positioning the transfer roller and the guide plate with respect to the photosensitive material drum, however, the support is made at four points, i.e., a pair of press-contacting points of the positioning roller for limiting the gap of the transfer roller relative to the photosensitive material drum and another pair of press-contacting points of the engaging protrusions of the guide plate relative to the stoppers. In practically assembling the apparatus, however, it can never be expected that these points are positioned on the same plane.

The positioning relying on the three-point support is most stable. However, the four-point support becomes absolutely necessary for positioning the transfer roller and the guide plate with respect to the photosensitive material drum. Here, it is quite likely that one point among the four points may be deviated from a common plane, causing the positioning to loose stability In particular, a problem stems from a pair of press-contacting points of the positioning roller for limiting the gap of the transfer roller with respect to the photosensitive material drum. When either one of these press-contacting points is deviated, the gap undergoes a change between the transfer roller and the photosensitive material drum, whereby the image density changes and the image is disturbed, making it difficult to transfer the image maintaining a predetermined quality.

This tendency becomes particularly conspicuous in the non-contacting transfer system in which the transfer roller and the photosensitive material drum are not contacted to each other.

SUMMARY OF THE INVENTION

It is therefore an object of the present invention to provide a transfer device in which a transfer roller and a guide plate are positioned with respect to the photosensitive material drum by being supported at four points including a pair of press-contacting points of a positioning roller for limiting the gap of the transfer roller to the photosensitive material drum and a pair of press-contacting points of engaging protrusions of the guide plate to the stoppers, wherein a stable and reliable contact is maintained at the pair of press-contacting points of the positioning roller to the photosensitive material drum, completely preventing the deviation in the press-contacting points, stably and reliably limiting the gap between the transfer roller and the photosensitive material drum, and, hence, forming an excellently transferred image.

According to the present invention, there is provided a transfer device comprising:

- a transfer roller facing a photosensitive material drum and for transferring a toner image on the photosensitive material drum onto a transfer sheet;
- a pair of positioning rollers (first roller and second roller) provided at both ends of a rotary shaft of the transfer roller for maintaining a predetermined gap between the transfer roller and the photosensitive material drum;
- a pair of resilient members for urging and pushing the positioning rollers onto the surface of the photosensitive material drum;
- a guide unit having a guide plate for guiding the transfer sheet into between the photosensitive material drum and the transfer roller, and being rotatably supported by the rotary shaft of the transfer roller;
- a pair of engaging protrusions provided at both ends of the guide plate; and at least one resilient means for urging the guide plate to push a back surface of the guide unit, so that the engaging protrusions come into contact with stoppers disposed on the side of the photosensitive material drum, the back surface being positioned at the side opposite to the guide plate;

wherein, when a straight line is regarded to be a support axis P connecting a press-contacting point between the positioning roller (first roller) of one side and the photosensitive material drum to a press-contacting point between the engaging protrusion of the other side (second roller side) and the stopper, a moment of the resilient member of the other side (second roller side) to the support axis P is larger than the sum of a moment of the resilient member of one side (first roller side) to the support axis P and a moment of the resilient means to the support axis P.

Concretely speaking, when a vertical plane passing through the support axis P is denoted by R, it is desired that the resilient members for urging the rollers and the resilient means for urging the guide plate are so provided as to satisfy the following formula (1), $$K_2 \times c_2 > \sum_{i=1}^{n} (Li \times ai) + K_1 \times c_1 \quad (1)$$

where $K_2$ is a distance (m) on the vertical plane R between the support axis P and a perpendicular drawn from a pushing end of the resilient member for urging the second roller to the vertical plane R;

$c_2$ is a pushing force (kgf) of the resilient member for urging the second roller;

$K_1$ is a distance (m) on the vertical plane R between the support axis P and a perpendicular drawn from a pushing end of the resilient member for urging the first roller to the vertical plane R;

$c_1$ is a pushing force (kgf) of the resilient member for urging the first roller;

n is a number of the resilient means for urging the guide plate:

Li is a distance (m) on the vertical plane R between the support axis P and a perpendicular drawn to the vertical plane R from a pushing end of an i-th resilient means as counted from the side of the second roller; and ai is a pushing force (kgf) of the i-th resilient means as counted from the side of the second roller.

Further, when a straight line is regarded to be a support axis Q connecting a press-contacting point between the second roller and the photosensitive material drum to a press-contacting point between the engaging protrusion of the side of the first roller and the stopper, and a vertical plane passing through the support axis Q is denoted by S, it is desired that the resilient members for urging the rollers and the resilient means for urging the guide plate are so provided as to satisfy not only the above-mentioned formula (1) but also the following formula (2), $$M_1 \times d_1 > \sum_{i=1}^{n} (Ni \times bi) + M_2 \times d_2 \quad (2)$$

where $M_1$ is a distance (m) on the vertical plane S between the support axis Q and a perpendicular drawn from a pushing end of the resilient member for urging the first roller to the vertical plane S;

$d_1$ is a pushing force (kgf) of the resilient member for urging the first roller;

$M_2$ is a distance (m) on the vertical plane S between the support axis Q and a perpendicular drawn from a pushing end of the resilient member for urging the second roller to the vertical plane S;

$d_2$ is a pushing force (kgf) of the resilient member for urging the second roller;

n is a number of the resilient means for urging the guide plate:

Ni is a distance (m) on the vertical plane S between the support axis Q and a perpendicular drawn to the vertical plane S from a pushing end of an i-th resilient means as counted from the side of the second roller; and bi is a pushing force (kgf) of the i-th resilient means as counted from the side of the second roller.

According to the present invention as described above, moments of the resilient members for urging the positioning rollers and of the resilient means for urging the guide plate are adjusted, so that a stable and reliable contact is maintained at the pair of press-contacting points of the positioning roller for limiting the gap of the transfer roller to the photosensitive material drum, completely preventing the deviation in the press-contacting points, stably and reliably limiting the gap between the transfer roller and the photosensitive material drum, and, hence, forming an excellently transferred image.

DETAILED DESCRIPTION OF THE INVENTION

Figure 1:
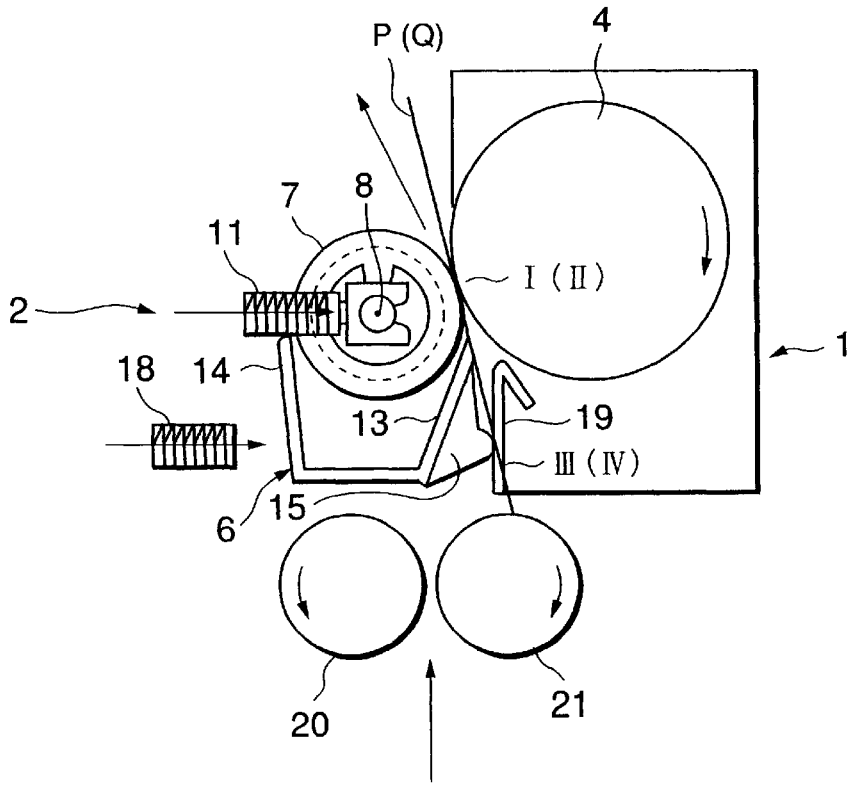
FIG. 1 is a side view illustrating major portions of an image-forming apparatus equipped with a transfer device of the present invention.

Referring to a concrete embodiment shown in FIG. 1, an image-forming apparatus is equipped with an image-forming unit 1 and a transfer device 2.

The image-forming unit 1 includes a photosensitive material drum 4 which is rotatable, and is surrounded by a main electrically charging mechanism, an image exposure mechanism and a developing mechanism in this order -though not diagramed.

Figure 2:
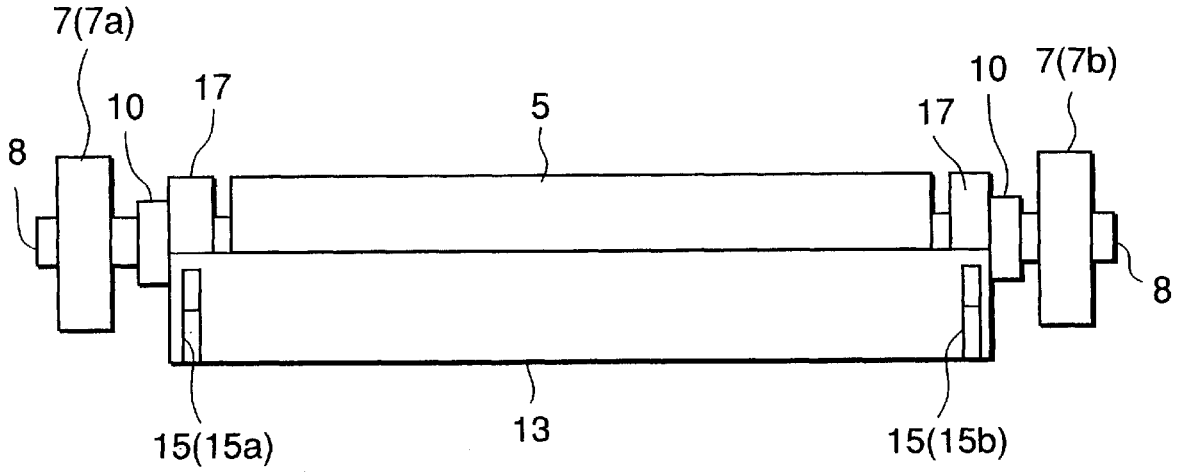
FIG. 2 is a front view of a transfer device of the present invention.

Referring to FIGS. 1 and 2, the transfer device 2 includes a transfer roller 5 and a guide unit 6. A pair of positioning rollers 7 (first roller 7*a* and a second roller 7*b*) are provided at both ends of the rotary shaft 8 of the transfer roller 5 in order to maintain constant a gap between the transfer roller 5 and the photosensitive material drum 4.

Figure 3:
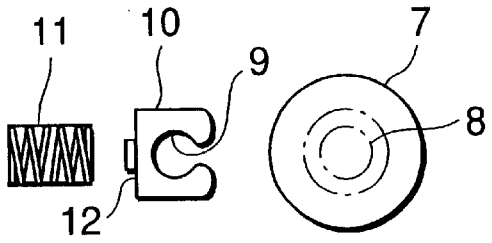
FIG. 3 is a view illustrating, in a disassembled manner, a transfer roller in the transfer device of the present invention.

The rotary shaft 8 of the transfer roller 5 is provided with pushing springs 11 for urging the positioning rollers 7 toward the photosensitive material drum 4. That is, as will be obvious from FIG. 3 illustrating the transfer roller 5 in a disassembled manner, bearings 10 are fitted to both end portions of the rotary shaft, the bearings 10 having a fitting portion 9 that fits to the rotary shaft 8 of the transfer roller 5. An end of the pushing spring 11 is supported by a receiving portion 12 of the bearing 10, and the other end thereof is supported by a frame (not shown) or the like. Due to the resilient force of the pushing springs 11, the positioning rollers 7 are urged and pushed onto the surface of the photosensitive material drum 4, whereby a predetermined gap is maintained between the transfer roller 5 and the photosensitive material drum 4.

Figure 4:
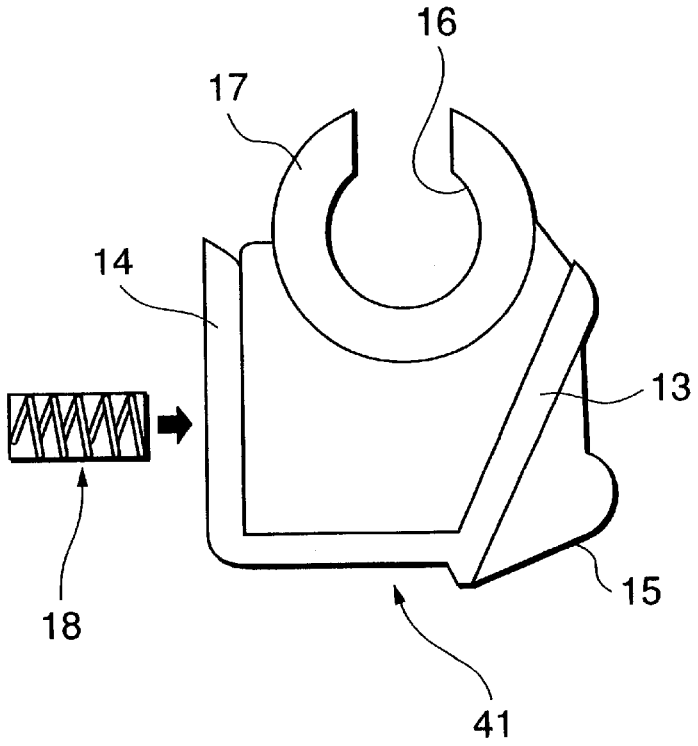
FIG. 4 is a side sectional view of a guide unit in the transfer device of the present invention.

Referring to FIG. 4 which is a side sectional view of the guide unit 6, the guide unit 6 includes a guide plate 13 for guiding a transfer sheet, a back-surface plate 14 forming a housing together with the guide plate 13, and bearings 17 having fitting portions 16 that fit to the rotary shaft 8 of the transfer roller 5.

Further, engaging protrusions 15 are formed at both ends of the guide plate 13, and at least one pushing spring 18 is attached to the outer surface of the back-surface plate 14 to turn the guide unit 6 in the counterclockwise direction in FIG. 1. An end of the pushing spring 18 is supported by the back-surface plate 14 of the guide unit 6, and the other end thereof is supported by the frame (not shown) or the like.

Thus, the guide unit 6 is rotatably supported by the rotary shaft 8 of the transfer roller 5 and is urged by the pushing spring 18 so as to turn in the counterclockwise direction. The engaging protrusions 15 come in contact with stoppers 19 formed on the image-forming unit or the machine frame, so that the guide plate 13 is positioned.

Under the guide unit 6 as shown in FIG. 1, there is provided a combination of a resist roller 21 and a roller 20 with a clutch for feeding the transfer sheet in synchronism with the transfer operation. Due to these rollers 20 and 21, the transfer sheet is fed into between the photosensitive material drum 4 and the transfer roller 5 through the guide plate 13. The transfer sheet onto which the toner-image is transferred is conveyed, in FIG. 1, into a fixing unit (not shown) disposed in an upper portion, and the transferred image is fixed by heat, pressure, etc.

In the transfer device 2, the transfer roller 5 and the guide plate 13 (guide unit 6) are positioned with respect to the photosensitive material drum 4 at four points including a pair of press-contacting points I, II of the rollers 7 (first roller 7*a* and second roller 7*b*) to the photosensitive material drum 4 and a pair of press-contacting points III, IV of the engaging protrusions 15 at both ends of the guide plate 13 to the stoppers 19. In FIG. 1, the press-contacting point of the second roller 7*b* on the front side is denoted by II, the press-contacting point of the first roller 7*a* on the back side is denoted by I, the press-contacting point of the engaging protrusion 15 of the front side (second roller 7*b* side) is denoted by IV, and the press-contacting point of the engaging protrusion 15 of the back side (first roller 7*a* side) is denoted by III.

Figure 5:
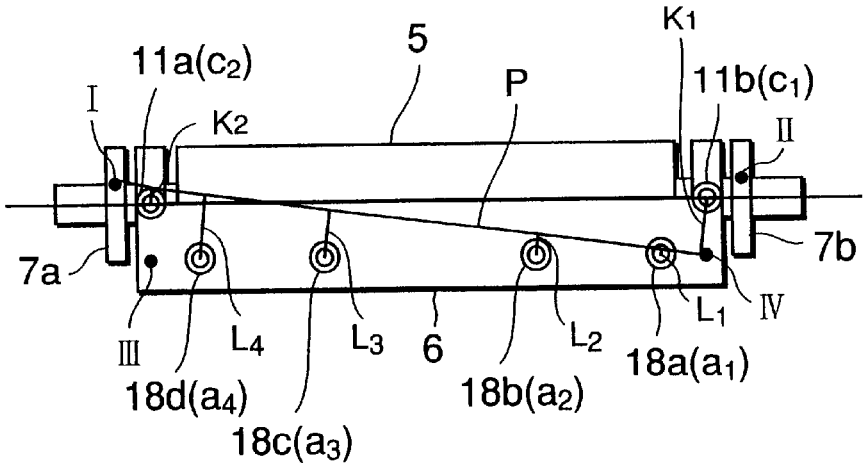
FIGS. 5 and 6 are views illustrating the distribution of moments of resilient members for urging the positioning rollers and of resilient means for urging the guide plate in the transfer device of the present invention.

In the present invention, the stable and reliable contacting state is maintained at the pair of press-contacting points I and II of the positioning rollers 7 to the photosensitive material drum 4, and the press-contacting state is completely prevented from being deviated. In the present invention as will be obvious from FIGS. 5 and 6, therefore, moments of the pushing springs 11 and 18 are so distributed that, when a straight line is regarded to be a support axis P (or Q) connecting the press-contacting point I (or II) between the first roller 7*a* (or the second roller 7*b*) and the photosensitive material drum 4 to a press-contacting point IV (or III) between the engaging protrusion 15*b* of the second roller 7*b* side (or the engaging protrusion 15*a* of the first roller 7*a* side) and the stopper 19, a moment of the pushing spring 11*b* of the second roller 7*b* side (or of the pushing spring 11*a* of the first roller 7*a* side) to the support axis P (or Q) is larger than the sum of a moment of the pushing spring 11*a* of the first roller 7*a* side (or of the spring 11*b* of the second roller 7*b* side) to the support axis P (or Q) and a moment of the pushing spring 18 to the support axis P (or Q). 30 FIG. 5 illustrates a case where the line connecting the press-contacting points I and IV is regarded to be a support axis P. The moment of the pushing spring 11*b* of the second roller 7*b* side to the support axis P gives a rotational force in the clockwise direction with respect to the support axis P (I–IV) in FIG. 1. On the other hand, the moment of the pushing spring 11*a* of the first roller 7*a* side with respect to the support axis P and the moment of the pushing spring 18 with respect to the support axis P, give a rotational force in the counterclockwise direction with respect to the support axis P (I–IV) in FIG. 1.

In the present invention, the moment in the clockwise direction is set to be larger than the moment in the counterclockwise direction. Therefore, the positioning rollers 7 and the guide unit 6 (guide plate 13) are so urged as to be turned in the clockwise direction about the support axis P, and a stably contacting state is established at the press-contacting point II.

Figure 6:
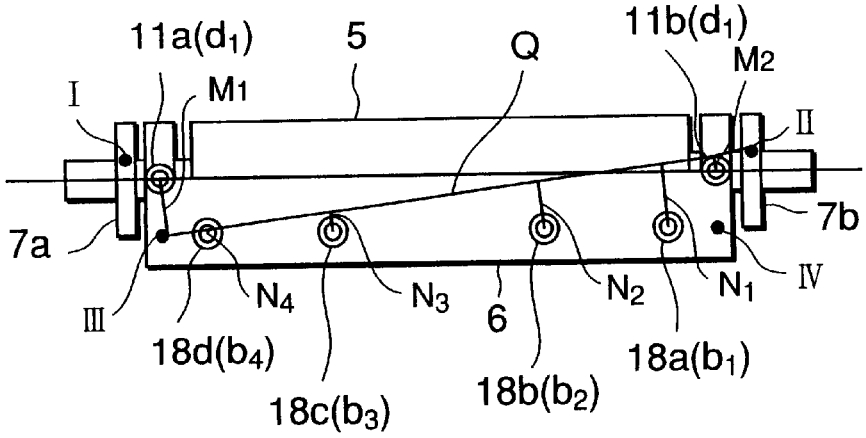

This quite holds true, too, in FIG. 6 which illustrates a case where the line connecting the press-contacting points II and III is regarded to be a support axis Q, and a stably contacting state is established at the press-contacting point I.

According to the present invention as described above, a stable and reliable contact is maintained at the pair of press-contacting points of the positioning roller (for limiting the gap of the transfer roller) to the photosensitive material drum, completely preventing the deviation in the press-contacting points, stably and reliably limiting the gap between the transfer roller and the photosensitive material drum, and, hence, forming an excellently transferred image.

The image is formed in a manner as described below in the image-forming apparatus of the present invention.

In forming the image, first, the photosensitive layer on the photosensitive material drum 4 is positively or negatively charged uniformly by the main electric charger in the image-forming unit 1. Due to this main electric charging, the surface potential (SP) of the photosensitive layer is usually set to lie within a range of from 500 to 700 V in absolute value.

Then, the image-exposure is executed by using a light beam such as laser beam in an optical system, whereby the potential becomes from 0 V to 100 V on the portion of the photosensitive layer corresponding to the original document (i.e., on the portion irradiated with the laser beam), and the potential on the portion (background) not irradiated with the laser beam is maintained at a dark potential attenuated from the main charged potential, and an electrostatic latent image is formed.

The electrostatic latent image is developed by the developer in the image-forming unit 1, and a toner image is formed on the surface of the photosensitive layer. Developing by the developer is effected by either positive developing or reversal developing. The reversal developing is effected by the magnetic brush developing method or the contact developing method using a developing agent that contains a toner electrically charged to the same polarity as the main charge polarity of the photosensitive layer, such as a one-component developing agent or a two-component developing agent. That is, the toner image charged to the same polarity as the main charge polarity is formed on the portion irradiated with the laser beam. In this case, a suitable bias voltage (DP) is applied across the developer and the photosensitive material drum 1 to effectively accomplish the developing, as done in a customary manner.

The toner image formed on the surface of the photosensitive layer is transferred onto the transfer sheet such as a paper passed into between the transfer roller 5 and the photosensitive material drum 4 through the guide plate 13. A predetermined gap is maintained between the transfer roller 5 and the photosensitive material drum 4 by the positioning rollers 7. Upon applying a predetermined transfer bias potential (TP) to the transfer roller 4, the toner is effectively transferred.

The transfer bias potential should have a polarity opposite to that of the toner-charging potential or the potential on the surface of the photosensitive material.

The transfer sheet onto which the toner image is transferred is sent to the fixing unit where the toner image is fixed to complete the formation of the image.

The transfer roller 4 is made of any electrically conducting rubber composition so that a transfer bias voltage (TP) can be applied thereto. A preferred electrically conducting rubber composition can be represented by an electrically conducting polyurethane rubber composition to which only, however, the electrically conducting rubber composition is not limited.

Desirably, the electrically conducting polyurethane rubber composition is cured so as to possess a rubber hardness of larger than 50 degrees (JIS A) and, preferably, 70 degrees.

The polyurethane rubber exhibits a rubbery elasticity due to the presence of a soft segment based on a polyester or a polyether and a hard segment based on aromatic chains bonded through an urethane bond or a urea bond in the polymer chains.

The polyurethane rubber is a polymer obtained by reacting a chain extender (crosslinking agent) with a polyurethane prepolymer (isocyanate-terminated polymer) that is obtained by reacting a polyol (hydroxyl group-terminated polymer) with a polyisocyanate compound.

The transfer roller is obtained by molding the composition of the polyurethane blended with an electrically conducting powder into a roller. The composition of the prepolymer and the chain extender (crosslinking agent) is blended with the electrically conducting powder prior to effecting the crosslinking, in order to accomplish homogeneous and uniform blending and dispersion.

It is desired that the electrically conducting rubber has a surface resistivity, generally, in a range of from $10^4$ to $10^{11}$ Ω·cm and, particularly, from $10^5$ to $10^{10}$ Ω·cm.

As the electrically conducting powder, there can be used electrically conducting carbon black and any metal powder such as of tin oxide, copper, silver or aluminum doped with indium or antimony. Among them, however, electrically conducting carbon black is preferred. It is desired that the content of the electrically conducting powder is in a range of from 5 to 70% by weight and, particularly, from 10 to 50% by weight per the whole amount.

In the present invention, the positioning rollers 7 for maintaining a predetermined gap between the transfer roller and the photosensitive material drum, are made of a plastic material having electrically insulating property, mechanical property and particularly excellent wear resistance. As the plastic material for constituting the positioning rollers 7, there is particularly preferably used a polybutylene terephthalate or a polycarbonate because it wears little and causes less wear to the photosensitive material drum that comes in contact with the positioning rollers. It is allowable to use other plastic materials such as polyoxymethylene (POM), nylon resin or the like material, as a matter of course.

The photosensitive material drum surface that comes in contact with the positioning rollers 7 for limiting the gap of the transfer roller may be coated with the photosensitive layer or may not be coated with the photosensitive layer permitting the electrically conducting substrate such as aluminum drum substrate to be exposed.

It is necessary that a relationship given by the following formula (3) holds between the radius (Rr) of the positioning rollers and the radius (Rt) of the transfer roller, $$Rr=Rt+d \tag{3}$$

where d is a gap maintained between the transfer roller and the surface of the photosensitive material.

According to this transfer gap system, it is desired that the distance (d) is maintained to be, generally, not larger than 1 mm and, particularly, from 0.2 to 0.5 mm. Due to a discharge current produced by a voltage applied to the transfer roller, the toner image is efficiently transferred while eliminating the defect of white spots that often develops when the transfer roller is used.

It is further desired that the width of the positioning rollers 7 contacting to the photosensitive material is generally in a range of from 1 to 10 mm and, particularly, from 3 to 6 mm.

Desirably, the photosensitive material used in the present invention has the photosensitive layer formed by applying the photosensitive layer-forming composition onto the electrically conducting substrate except the end thereof, permitting the electrically conducting substrate to be exposed at portions into which the positioning rollers come in contact.

A hollow or solid aluminum drum is in many cases used as the electrically conducting substrate. The drum may be made of pure aluminum. In general, however, it is desired to use an aluminum alloy from the standpoint of strength, rigidity and corrosion resistance. The aluminum alloy contains metals such as Si, Fe, Cu, Mn, Mg, Cr, Ti, Ni and the like.

Embodiment

An embodiment of the invention will now be described with reference to FIGS. 5 and 6. FIG. 5 illustrates a relationship of moments of when a straight line I–IV is regarded to be a support axis P connecting a press-contacting point I between the positioning roller (first roller) 7*a* of one side and the photosensitive material drum 4 to a press-contacting point IV between the engaging protrusion 15*b* of the other side (second roller side 7*b*) and the stopper 19*b*, and a vertical plane passing through the support axis P is regarded to be R.

In the example of FIG. 5, the positioning roller 7*b* at the press-contacting point II is effectively prevented from floating by setting the pushing springs 11*a*, 11*b* for urging the positioning rollers and the pushing springs 18*a*, 18*b*, 18*c* and 18*d* for urging the guide plate so as to satisfy the following formula (1), $$K_2 \times c_2 > \sum_{i=1}^{n} (Li \times ai) + K_1 \times c_1 \quad (1)$$

where $K_2$ is a distance (m) on the vertical plane R between the support axis P and a perpendicular drawn from a pushing end of the resilient member (pushing spring 11*b*) for urging the second roller 7*b* to the vertical plane R;

$c_2$ is a pushing force (kgf) of the resilient member (pushing spring 11*b*) for urging the second roller 7*b;*

$K_1$ is a distance (m) on the vertical plane R between the support axis P and a perpendicular drawn from a pushing end of the resilient member (pushing spring 11*a*) for urging the first roller 7*a* to the vertical plane R;

$c_1$ is a pushing force (kgf) of the resilient member (pushing spring 11*a*) for urging the first roller 7*a;* n is a number of the resilient means (pushing springs 18) for urging the guide plate:

Li is a distance (m) on the vertical plane R between the support axis P and a perpendicular drawn to the vertical plane R from a pushing end of an i-th resilient means (pushing spring 18) for urging the guide plate as counted from the side of the second roller 7*b*; and ai is a pushing force (kgf) of the i-th resilient means (pushing spring 18) for urging the guide plate as counted from the side of the second roller 7*b*.

FIG. 6 illustrates a relationship of moments of when a straight line II–III is regarded to be a support axis Q connecting a press-contacting point II between the positioning roller (second roller) 7*b* of the other side and the photosensitive material drum 4 to a press-contacting point III between the engaging protrusion 15*a* of one side (first roller side 7*a*) and the stopper 19*a*, and a vertical plane passing through the support axis Q is regarded to be S.

In the example of FIG. 6, the positioning roller 7*a* at the press-contacting point I is effectively prevented from floating by setting the pushing springs 11*a*, 11*b* for urging the positioning rollers and the pushing springs 18*a*, 18*b*, 18*c* and 18*d* for urging the guide plate so as to satisfy the following formula (2), $$M_1 \times d_1 > \sum_{i=1}^{n} (Ni \times bi) + M_2 \times d_2 \quad (2)$$

where $M_1$ is a distance (m) on the vertical plane S between the support axis Q and a perpendicular drawn from a pushing end of the resilient member (pushing spring 11*a*) for urging the first roller 7*a* to the vertical plane S;

$d_1$ is a pushing force (kgf) of the resilient member (pushing spring 11*a*) for urging the first roller 7*a;*

$M_2$ is a distance (m) on the vertical plane S between the support axis Q and a perpendicular drawn from a pushing end of the resilient member (pushing spring 11*b*) for urging the second roller 7*b* to the vertical plane S;

$d_2$ is a pushing force (kgf) of the resilient member (pushing spring 11*b*) for urging the second roller 7*b;* n is a number of the resilient means (pushing springs 18) for urging the guide plate:

Ni is a distance (m) on the vertical plane S between the support axis Q and a perpendicular drawn to the vertical plane S from a pushing end of an i-th resilient means (pushing spring 18) for urging the guide plate as counted from the side of the second roller 7*b*; and bi is a pushing force (kgf) of the i-th resilient means (pushing spring 18) for urging the guide plate as counted from the side of the second roller 7*b*.

The pushing springs 11*a*, 11*b* for urging the positioning rollers and the pushing springs 18*a*, 18*b*, 18*c* and 18*d* for urging the guide plate, are extending in a horizontal direction at an angle at right angles with the shaft 8 of the transfer roller 5. The urging direction of these springs may not often be necessarily in agreement with the direction of the perpendicular drawn from the ends of the springs to the vertical plane R or S.

However, the partial force of the pushing force in the direction of the perpendicular from the ends of the springs to the vertical plane R or S, is obtained by multiplying the pushing force of the spring by cos θ (θ is an angle between the vertical plane passing through the support axis P or Q and the vertical plane passing through the rotary shaft 8). This applies to both the right side and the left side of the formulas (1) and (2), and its effect can be canceled when the magnitudes are to be compared.

In the present invention, the moment of the left side of the formulas (1) and (2) can be effectively increased by increasing the pushing forces of the pushing springs 11*a* and 11*b* for urging the positioning rollers. The moment on the left side of the formulas can also be effectively increased by increasing the distance between the pushing spring 11*b* urging the second roller 7*b* and the press-contacting point IV or by increasing the distance between the pushing spring 11*a* urging the first roller 7*a* and the press-contacting point III.

It is desired that the pushing springs 18 for urging the guide are generally provided in a number of from 1 to 10 and, preferably, from 2 to 4. The individual moments on the right side of the formulas (1) and (2) can be decreased by setting the total pushing force by the pushing springs 18 t o be constant and by arranging many pushing springs 18 in a dispersed manner.

What is claimed is:

1. A transfer device comprising:

a transfer roller facing a photosensitive material drum and for transferring a toner image on the photosensitive mateal drum onto a transfer sheet;

a pair of positioning rollers provided at both ends of a rotary shaft of the transfer roller for maintaining a predetermined gap between the transfer roller and the photosensitive material drum;

a pair of resilient members for urging and pushing said positioning rollers onto the surface of the photosensitive material drum;

a guide unit having a guide plate for guiding the transfer sheet into between the photosensitive material drum and the transfer roller, and being rotatably supported by the rotary shaft of the transfer roller;

a pair of engaging protrusions provided at both ends of said guide plate; and at least one resilient means for urging the guide plate to push a back surface of said guide unit, so that said engaging protrusions come into contact with stoppers disposed on the side of the photosensitive material drum, the back surface being positioned at the side opposite to the guide plate;

wherein, when a straight line is regarded to be a support axis P connecting a press-contacting point between the positioning roller of one side and the photosensitive material drum to a press-contacting point between the engaging protrusion of the other side and the stopper, a moment of the resilient member for urging the positioning roller of the other side to the support axis P is larger than the sum of a moment of the resilient member for urging the positioning roller of one side to the support axis P and a moment of the resilient means for urging the guide plate to the support axis P.

2. A transfer device according to claim 1, wherein when the positioning roller on said one side is regarded to be a first roller, the positioning roller on said other side to be a second roller and a vertical plane passing through the support axis P to be R, the resilient members for urging said rollers and the resilient means for urging said guide plate produce the pushing forces that satisfy the following formula (1), $$K_2 \times c_2 > \sum_{i=1}^{n} (Li \times ai) + K_1 \times c_1 \quad (1)$$

where $K_2$ is a distance (m) on the vertical plane R between said support axis P and a perpendicular drawn from a pushing end of the resilient member for urging the second roller to said vertical plane R;

$c_2$ is a pushing force (kgf) of the resilient member for urging the second roller;

$K_1$ is a distance (m) on the vertical plane R between said support axis P and a perpendicular drawn from a pushing end of the resilient member for urging the first roller to said vertical plane R;

$c_1$ is a pushing force (kgf) of the resilient member for urging the first roller;

n is a number of the resilient means for urging the guide plate:

Li is a distance (m) on the vertical plane R between said support axis P and a perpendicular drawn to said vertical plane R from a pushing end of an i-th resilient means as counted from the side of the second roller; and ai is a pushing force (kgf) of the i-th resilient means as counted from the side of the second roller.

3. A transfer device according to claim 2, wherein, when a straight line is regarded to be a support axis Q connecting a press-contacting point between the second roller and the photosensitive material drum to a press-contacting point between the engaging protrusion of the side of the first roller and the stopper, and a vertical plane passing through the support axis Q to be S, the resilient members for urging the rollers and the resilient means for urging the guide plate produce pushing forces that satisfy following formula (2), $$M_1 \times d_1 > \sum_{i=1}^{n} (Ni \times bi) + M_2 \times d_2 \quad (2)$$

where $M_1$ is a distance (m) on the vertical plane S between said support axis Q and a perpendicular drawn from a pushing end of the resilient member for urging the first roller to said vertical plane S;

$d_1$ is a pushing force (kgf) of the resilient member for urging the first roller;

$M_2$ is a distance (m) on said vertical plane S between said support axis Q and a perpendicular drawn from a pushing end of the resilient member for urging the second roller to said vertical plane S;

$d_2$ is a pushing force (kgf) of the resilient member for urging the second roller;

n is a number of the resilient members for urging the guide plate:

Ni is a distance (m) on said vertical plane S between said support axis Q and a perpendicular drawn to said vertical plane S from a pushing end of an i-th resilient means as counted from the side of the second roller; and bi is a pushing force (kgf) of the i-th resilient means as counted from the side of the second roller.

4. A transfer device according to claim 1, wherein said transfer roller and said photosensitive material drum are held in a state of not being contacted to each other due to the positioning rollers.

* * * * *